US007632119B1

(12) United States Patent
Ma et al.

(10) Patent No.: US 7,632,119 B1
(45) Date of Patent: Dec. 15, 2009

(54) POWER ADAPTER

(75) Inventors: Jian Rong Ma, Tu-Cheng (TW); Hai Yan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/222,468

(22) Filed: Aug. 11, 2008

(51) Int. Cl.
*H01R 29/00* (2006.01)

(52) U.S. Cl. ..... 439/172; 439/333

(58) Field of Classification Search ..... 439/131, 439/132, 172, 171, 176, 518, 332, 333
See application file for complete search history.

(56) References Cited

U.S. PATENT DOCUMENTS 2,496,173 A * 1/1950 Peebles ..... 439/171
4,713,393 A * 12/1987 Chang et al. ..... 514/469
6,190,184 B1 * 2/2001 Cimbal et al. ..... 439/131
6,328,581 B1 * 12/2001 Lee et al. ..... 439/106
6,821,134 B2 * 11/2004 Chen ..... 439/131
6,942,508 B2 * 9/2005 Wong ..... 439/171
7,001,196 B1 * 2/2006 Huang ..... 439/320
7,125,266 B1 * 10/2006 Huang ..... 439/131
7,168,969 B1 * 1/2007 Wang ..... 439/173
2006/0068608 A1 * 3/2006 McFadden ..... 439/22

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

A power adapter has a main body. A top of the main body defines a recess and an annular sidewall enclosing the recess. The recess has a locating depression arranged at a bottom thereof to be deviated from the center of the bottom. A plug is rotatably and detachably mounted in the recess. An elastic component mounted in the plug defines a contacting portion elastically protruding out of a bottom of the plug. The plug is locked in the recess by rotation so that the contacting portion is pressed against the bottom surface of the recess and compressed back elastically and then the contacting portion engages the locating depression under resilience action of the elastic component for preventing the plug from rotating with respect to the main body.

6 Claims, 3 Drawing Sheets

POWER ADAPTER

BACKGROUND OF THE INVENTION

1. Field of the Invention

The present invention relates to a power adapter, and more particularly to a power adapter which is convenient to replace a plug of the power adapter.

2. The Related Art

With the development of the electronic technology, more and more portable electrical devices are designed and manufactured for meeting people' requirements. Consequently, the popularity of the portable electrical devices presents demand of power adapters. The conventional power adapter includes a main body and a plug mounted on the main body. The main body is equipped with an elastic component. After assembled, the elastic component is automatically pressed against the plug for fixing the plug to the main body stably.

However, when the plug is taken away from the main body, the elastic component is firstly compressed down so that the plug can disengage from the main body. But, if the user forgets to press the elastic component and then takes the plug away from the main body directly, the engagement between the main body and the plug will be destroyed. So the conventional power adapter is not convenient for replacing the plug.

SUMMARY OF THE INVENTION

Accordingly, an object of the present invention is to provide a power adapter which is convenient to exchange a plug of the power adapter.

A power adapter has a main body. A top of the main body defines a recess and an annular sidewall enclosing the recess. The recess has a locating depression arranged at a bottom thereof to be deviated from the center of the bottom. A plug is rotatably and detachably mounted in the recess. An elastic component mounted in the plug defines a contacting portion elastically protruding out of a bottom of the plug. The plug is locked in the recess by rotation so that the contacting portion is pressed against the bottom surface of the recess and compressed back elastically and then the contacting portion engages the locating depression under resilience action of the elastic component for preventing the plug from being rotated with respect to the main body.

As described above, in assembly, the contacting portion of the elastic component engages the locating depression under the action of elastic force, which prevents the plug from rotating with respect to the main body so as to assemble the plug with the main body firmly. In disassembly, an opposite force is applied to the plug to drive the plug to rotate with respect to the main body; the contacting portion disengages from the locating depression and is compressed elastically so that the plug can be taken away from the main body. The power adapter of such structure is not only convenient to assemble and disassemble, but also can protect the engagement between the main body and the plug.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
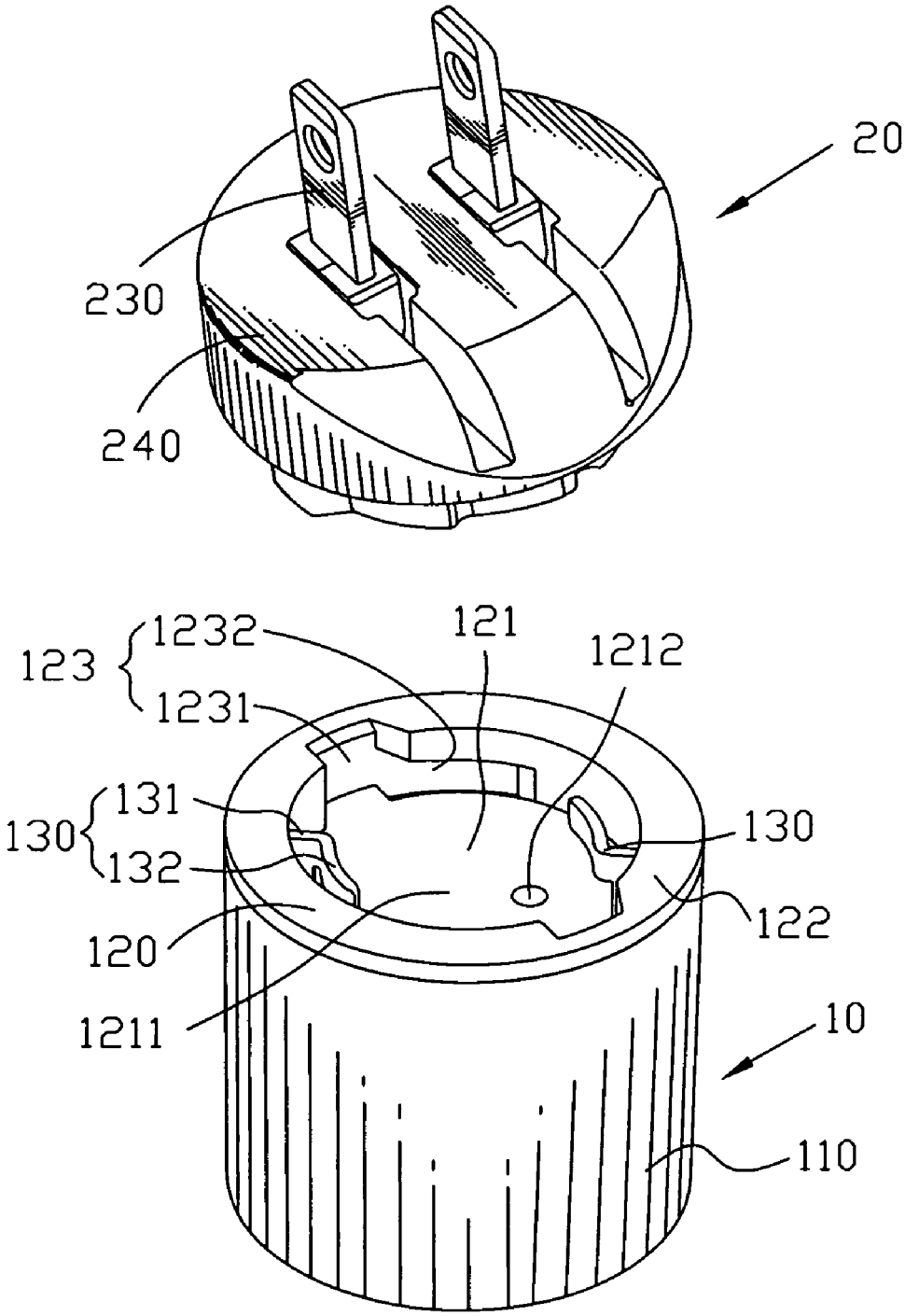
FIG. 1 is a schematic view showing a power adapter in a preferred embodiment according to the present invention.
Figure 2:
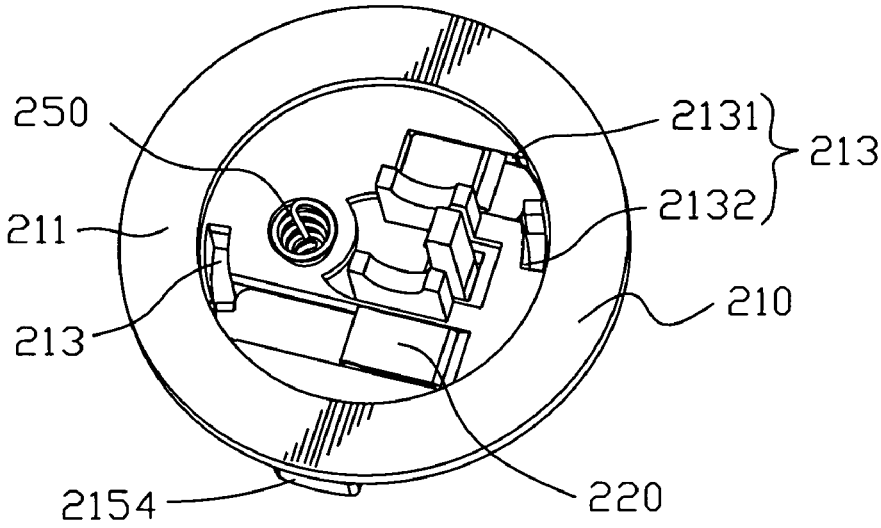
FIG. 2 is an assembled, perspective view of a plug of the power adapter shown in FIG. 1 while seen from a top view, wherein a cover and a connecting terminal are removed.

With reference to FIG. 1 and FIG. 2, a power adapter includes a case 10 and a plug 20 coupling with the case 10. The case 10 has a main shell 110 and a main body 120 mounted at an end of the main shell 110. The main shell 110 is of a cylindrical shape.

The main body 120 is of a disk shape and defines a recess 121 therein and an annular sidewall 122 enclosing the recess 121. The recess 121 defines a circular bottom surface 1211. The bottom surface 1211 has a locating depression 1212 formed therein. The locating depression 1212 is arranged in an eccentric manner such that it deviates from the center of the circular bottom surface 1211. The annular sidewall 122 is partially recessed inwardly from an inner surface thereof to form two fixing recesses 123 symmetrical about the center of the bottom surface 1211. The fixing recess 123 includes a guiding recess 1231 extending upward and downward and passing through a top portion of the annular sidewall 122, and a sliding recess 1232 communicating with the guiding recess 1231. The sliding recess 1232 extends along the circumferential direction of the annular sidewall 122 and is adjacent to the bottom surface 1211.

A plurality of main terminals 130 is mounted in the recess 121. The main terminal 130 defines a fixed portion 131 inserted into the bottom surface 1211 and a connecting portion 132 bending and extending from a top side of the fixed portion 131. The connecting portion 132 extends along a direction parallel to the circumference of the annular sidewall 122 to show an arc shape.

Figure 3:
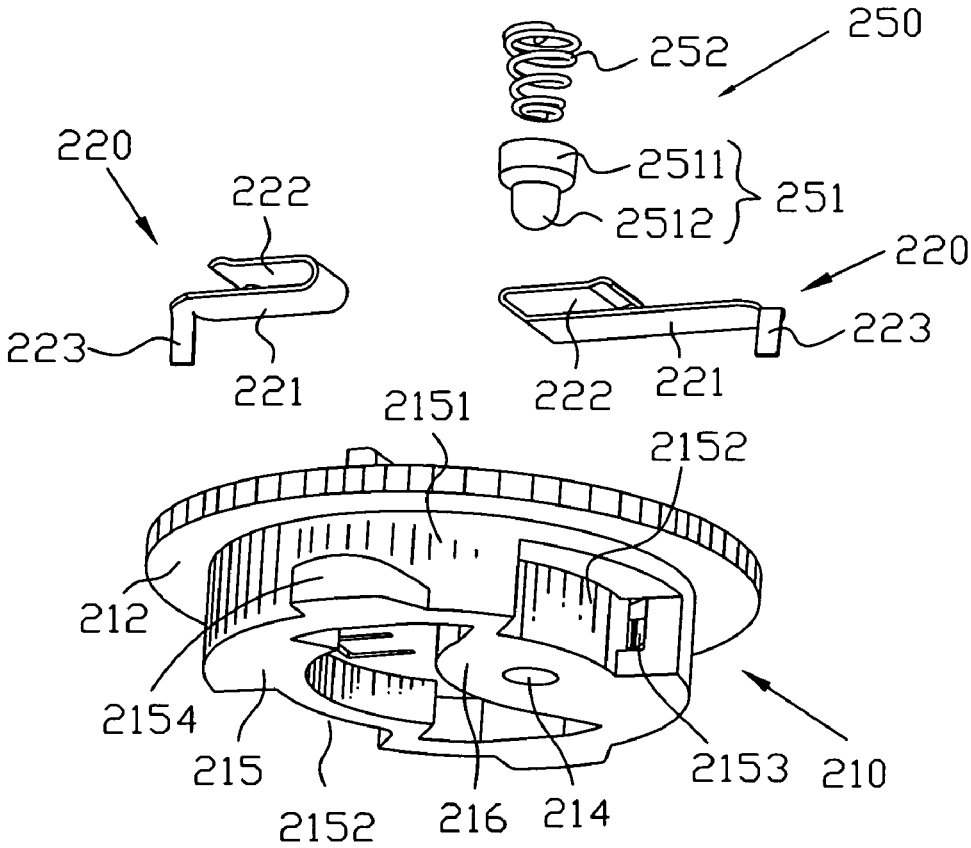
FIG. 3 is an exploded, perspective view of the plug of the power adapter shown in FIG. 1 while seen from a front and bottom view, wherein the cover and the connecting terminal are removed.
Figure 4:
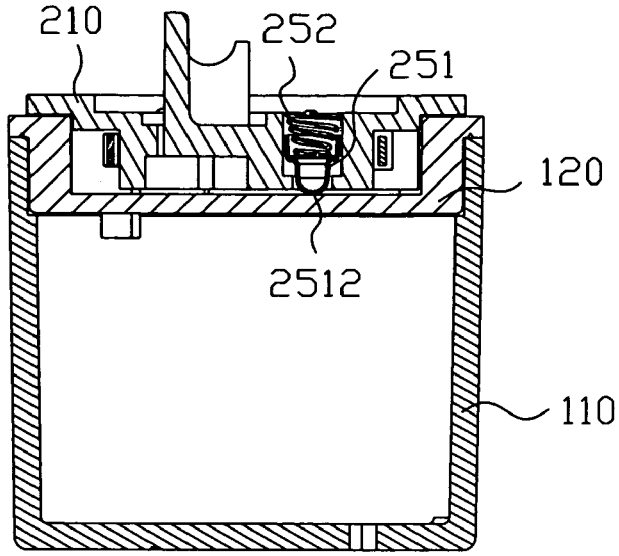
FIG. 4 is a cross-sectional view illustrating state of the plug rotating with respect to a case of the power adapter shown in FIG. 1, wherein the cover, the connecting terminal and a conducting terminal are removed.
Figure 5:
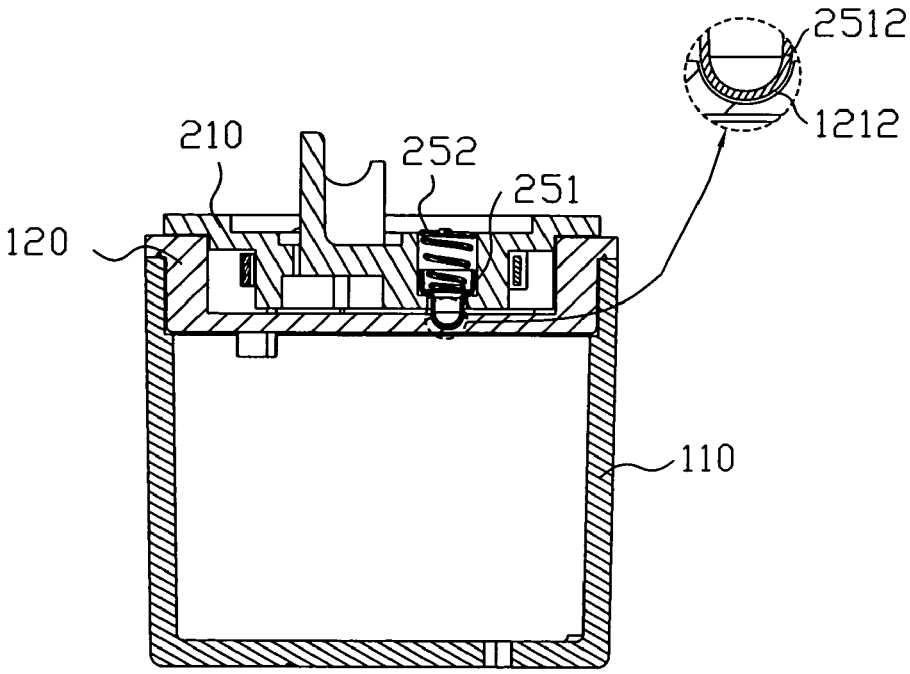
FIG. 5 is a cross-sectional view illustrating state of the plug assembled to the case of the power adapter shown in FIG. 1, wherein the cover, the connecting terminal and the conducting terminal are removed.

Please refer to FIG. 1 and FIG. 3, the plug 20 includes a plug body 210, two conducting terminals 220 and two connecting terminals 230 and a cover 240. Each connecting terminal 230 is located in the plug body 210, with a free end of the connecting terminal 230 passing through the cover 240 and extending out of the cover 240 for electrically connecting with a socket.

Please refer to FIG. 2 and FIG. 3, the plug body 210 is of a disk shape and defines a top surface 211 and a bottom surface 212. The top surface 211 has two conducting recesses 213 corresponding to respective conducting terminals 220. The conducting recess 213 includes a first cavity 2131 and a second cavity 2132 communicating with the first cavity 2131. The first cavity 2131 is recessed downward from the top surface 211 to show a substantially oblong shape. The second cavity 2132 is of an arc-shape and recessed downward from the top surface 211 to reach the bottom surface 212. The top surface 211 further has a positioning hole 214 corresponding to the locating depression 1212. The positioning hole 214 passes through the whole plug body 120 axially and is adopted to receive an elastic component 250 therein.

The bottom surface 212 extends downward to form a first extension portion 215 and a second extension portion 216 protruding from an inner surface of the first extension portion 215. The first extension portion 215 shows substantially a ring-shape and defines an outer side 2151. The outer side 2151 is recessed toward the centerline of the first extension portion 215 to form a receiving recess 2152 corresponding to the connecting portion 132 of the main terminal 130. A bottom side of the receiving recess 2152 extends along circumference of the first extension portion 215 to form an ending recess 2153. The ending recess 2153 communicates with the second cavity 2132. The outer side 2151 protrudes radially and outwardly to form two protrusion portions 2154 for mating with the fixing recesses 123. The second extension portion 216 is located in the ring formed by the first extension portion 215; the positioning hole 214 is opened in the second extension portion 216.

The conducting terminal 220 received in the conducting recess 213 defines a basic plate 221 corresponding to the first cavity 2131. The basic plate 221 is of an oblong shape. One end of the basic plate 221 bends and extends to form a conducting piece 222 parallel to the basic plate 221 with a space formed therebetween. The other end of the basic plate 221 extends perpendicularly to form a conducting end 223. In assembly, the basic plate 221 is disposed in the first cavity 2131, and the conducting piece 222 is located above the basic plate 221 for electrically connecting with the connecting terminal 230, while the conducting end 223 is inserted into the second cavity 2132.

The elastic component 250 comprises a containing shell 251 and a spring 252 received in the containing shell 251. The containing shell 251 defines a receiving portion 2511 and a contacting portion 2512 connecting with an end of the receiving portion 2511. The receiving portion 2511 and the contacting portion 2512 are all cylindrical and communicate with each other; the diameter of the receiving portion 2511 is bigger than that of the contacting portion 2512. A free end of the contacting portion 2512 is of a dome shape. The containing shell 251 is placed in the positioning hole 214 from the top surface 211. The contacting portion 2512 is partly received in the positioning hole 214; the free end of the contacting portion 2512 extends out of a bottom surface of the second extension portion 216. In this embodiment, the diameter of one end of the spring 252 is smaller than that of the other end, which is convenient to assemble the containing shell 251 and spring 252 together.

Please refer to FIG. 1 and FIGS. 3-5, when the user wants to assemble the case 10 and the plug 20, firstly, the plug 20 has to be adjusted to be located in the recess 121 of the case 10 such that the protrusion portions 2154 will be wedged into the respective guiding recesses 1221 whilst the connecting portions 132 are received in the receiving recesses 2152. At this time, the contacting portion 2512 is pressed against the bottom surface 1211 of the recess 121 so that the spring 252 is compressed elastically. Then the user can rotate clockwise the plug 20 an angle with respect to the case 10 so that the plug 20 engages snuggly with the case 10, the protrusion portions 2154 slides into the sliding recess 1232 and the connecting portion 132 slides into the ending recess 2153 to electrically connect with the conducting end 223 of the conducting terminal 220. At this time, the contacting portion 2512 engages the locating depression 1212 under resilience action of the spring 252 to prevent the plug 20 from rotating with respect to the case 10. Thus the plug 20 is fixed to the case 10 firmly.

As described above, in assembly, the contacting portion 2512 engages the locating depression 1212 under the resilience action of the spring 252, and accordingly, this prevents the plug 20 from being rotated with respect to the case 10 so as to assemble the plug 20 with the case 10 firmly. In disassembly, an opposite force is applied to the plug 20 to drive the plug 20 to rotate with respect to the case 10 in an opposite direction, and in this process, the contacting portion 2512 slides out of the locating depression 1212 accompanied with the spring 252 compressed elastically so that the plug 20 disengages from the case 10. Such structure of the power adapter is not only convenient to assemble and disassemble, but also can protect the engagement between the case 10 and the plug 20.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power adapter comprising:

a main body, a top of the main body defining a recess and an annular sidewall enclosing the recess, the recess having a locating depression arranged at a bottom surface thereof so that the locating depression is deviated from a center of the bottom;

a plug rotatably and detachably mounted in the recess; and an elastic component mounted in a plug body of the plug and defining a contacting portion elastically protruding out of a bottom of the plug body, wherein the plug is locked in the recess by rotation with the contacting portion being elastically pressed against the bottom surface of the recess and then the contacting portion is located in the locating depression under resilience action of the elastic component for preventing the plug from being rotated with respect to the main body.

2. The power adapter as claimed in claim 1, wherein the plug has a conducting terminal received in the plug body, the conducting terminal defines a basic plate, one end of which connects with a conducting piece parallel to the basic plate, and the other end of the basic plate bends opposite to the conducting piece to form a conducting end.

3. The power adapter as claimed in claim 1, wherein the plug body has a conducting recess formed in a top thereof for receiving a conducting terminal, the plug body has a receiving recess defined in a side thereof and an ending recess communicating with the receiving recess and the conducting recess, a main terminal received in the main body defines a connecting portion, the connecting portion is placed in the receiving recess and then slid into the ending recess for electrically connecting with the conducting terminal.

4. The power adapter as claimed in claim 1, wherein the plug body defines a positioning hole passing therethrough, the elastic component has a containing shell received in the positioning hole and a spring received in the containing shell, and one end of the containing shell defines the contacting portion passing through the positioning hole.

5. The power adapter as claimed in claim 4, wherein the contacting portion has a free end of a dome shape for sliding in or out of the locating depression smoothly.

6. The power adapter as claimed in claim 4, wherein the containing shell has a receiving portion and the contacting portion is connected with one end of the receiving portion, the receiving portion and the contacting portion are all cylindrical and communicate with each other, and the diameter of the receiving portion is bigger than that of the contacting portion.

* * * * *